US011466451B2

(12) United States Patent
Steinbicker

(10) Patent No.: US 11,466,451 B2
(45) Date of Patent: Oct. 11, 2022

(54) PANEL ATTACHMENT STRUCTURE

(71) Applicant: Joseph J. Steinbicker, Lake Mary, FL (US)

(72) Inventor: Joseph J. Steinbicker, Lake Mary, FL (US)

(73) Assignee: COPPER HARBOR INVESTMENTS, LLC, Lake Mary, FL (US)

( * ) Notice: Subject to any disclaimer, the term of this patent is extended or adjusted under 35 U.S.C. 154(b) by 0 days.

(21) Appl. No.: 17/173,817

(22) Filed: Feb. 11, 2021

(65) Prior Publication Data

US 2022/0251834 A1 Aug. 11, 2022

(51) Int. Cl.
*E04B 2/86* (2006.01)
*E04G 17/065* (2006.01)
*E04C 5/01* (2006.01)

(52) U.S. Cl.
CPC ..... *E04B 2/8635* (2013.01); *E04C 5/01* (2013.01); *E04G 17/0658* (2013.01); *E04B 2103/02* (2013.01)

(58) Field of Classification Search
CPC ..... E04B 2/8635; E04B 2103/02; E04B 1/41; E04C 5/01; E04G 17/0658; E04G 21/185
See application file for complete search history.

(56) References Cited

U.S. PATENT DOCUMENTS 827,613 A 7/1906 Brown
1,546,901 A * 7/1925 Anders ..... E04B 1/4107 52/708
5,609,005 A 3/1997 Schierloh et al.
6,494,639 B1 * 12/2002 Friend ..... E04B 1/043 403/403
6,658,810 B2 12/2003 DeLoach, Sr.
7,114,695 B2 10/2006 DeLoach, Sr.
7,743,580 B2 * 6/2010 DeLoach, Sr. ..... E04C 5/12 52/708
8,011,144 B2 * 9/2011 Compton ..... E02D 27/02 52/169.11
D666,078 S 8/2012 Foley et al.
D672,221 S 12/2012 Tincher
8,448,397 B2 5/2013 Tincher et al.
D839,083 S 1/2019 Silva
10,221,558 B1 3/2019 Silva et al.
10,577,789 B2 3/2020 Kelly et al.
(Continued)

OTHER PUBLICATIONS

Product literature for "AdvanCONN PC-10 Precast Panel to Foundation Connection," by AdvanCONN, 3 pages, published as late as Aug. 27, 2020.

(Continued)

*Primary Examiner* — Gisele D Ford
(74) *Attorney, Agent, or Firm* — Thompson Hine LLP

(57) ABSTRACT

A panel attachment structure including a panel assembly having a channel member including a channel therein. The panel assembly further includes at least one reinforcing member directly or indirectly coupled to the channel member, and an insert assembly including an insert portion. The insert portion is configured to be closely slidably received in the channel member in an insertion direction, and the insert assembly is configured to be coupled to an underlying support structure.

31 Claims, 10 Drawing Sheets

(56) References Cited

U.S. PATENT DOCUMENTS

| | | | | |
|---|---|---|---|---|
| 2006/0000168 | A1* | 1/2006 | Compton | E04B 1/167 52/292 |
| 2010/0170185 | A1* | 7/2010 | Birnbaum | E04B 1/4107 52/699 |
| 2011/0239581 | A1 | 10/2011 | Linares, III | |
| 2013/0232897 | A1 | 9/2013 | Tincher et al. | |
| 2015/0315777 | A1* | 11/2015 | Broughton | E04B 5/12 52/289 |

OTHER PUBLICATIONS

Product literature for "Super Link®," by MeadowBurke, 2 pages, published as late as Aug. 28, 2020.
Product literature for "Slant Anchor," by SureBuilt Concrete Forms & Accessories, 4 pages, Jun. 2020.
U.S. Patent and Trademark Office (ISA/US), International Search Report and Written Opinion of the International Searching Authority, International Application No. PCT/US2022/015743, 10 pages, dated Apr. 15, 2022.

* cited by examiner

PANEL ATTACHMENT STRUCTURE

The present invention is directed to a panel attachment structure, and more particularly, to a panel attachment structure that can be used to secure a panel to a support structure.

BACKGROUND

Panel attachment structures are commonly used in the construction industry to secure a panel, such as a wall, to an underlying floor, foundation or footing. However, many existing panel attachment structure are difficult to install, may not provide a sufficiently secure connection, require multiple trades to install and/or do not present a pleasing appearance once installed.

SUMMARY

In one embodiment the present invention is directed to a panel attachment structure including a panel assembly having a channel member including a channel therein. The panel assembly further includes at least one reinforcing member directly or indirectly coupled to the channel member, and an insert assembly including an insert portion. The insert portion is configured to be closely slidably received in the channel member in an insertion direction, and the insert assembly is configured to be coupled to an underlying support structure.

BRIEF DESCRIPTION OF DRAWINGS

FIG. 3 is an end view of the panel attachment structure of FIG. 1;

FIG. 12 is a side view of the panel attachment structure of FIG. 11;

FIG. 16 is an upper perspective view of another embodiment of the panel attachment structure of the present invention;

DETAILED DESCRIPTION

Figure 5:
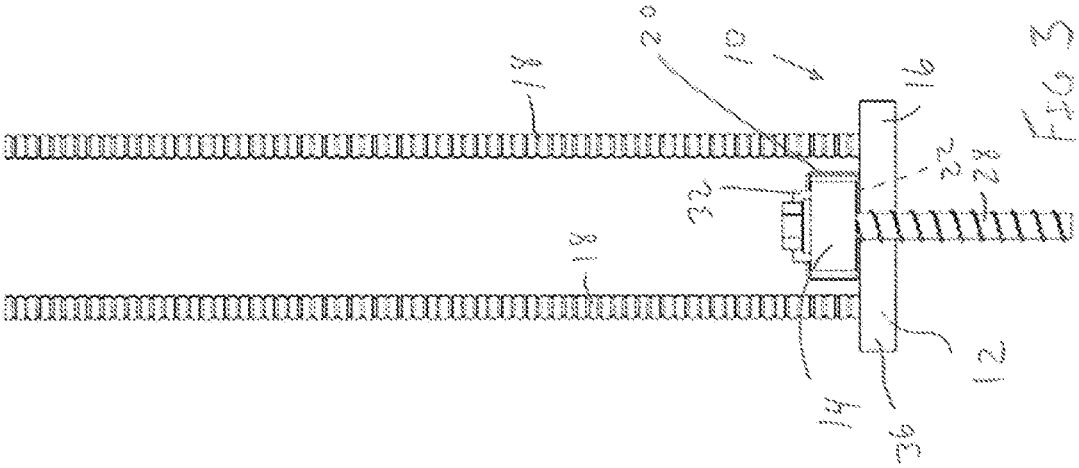
FIG. 5 illustrates the panel attachment structure of FIG. 1, with the insert exploded away from the panel assembly.
Figure 2:
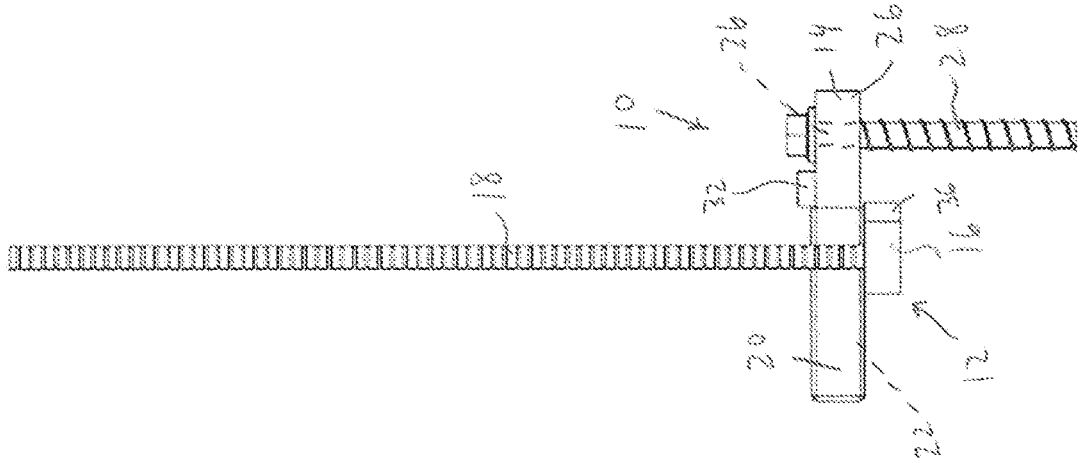
FIG. 2 is a side view of the panel attachment structure of FIG. 1.
Figure 1:
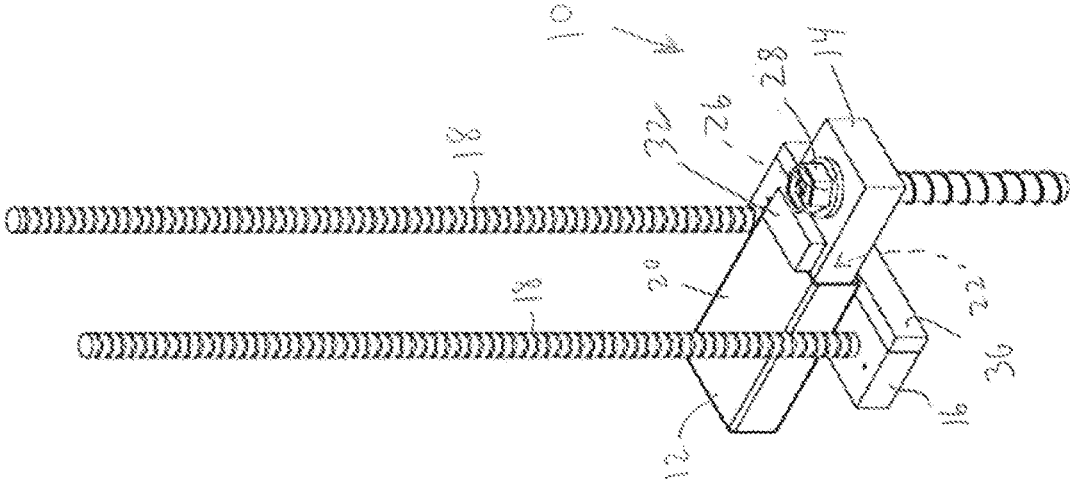
FIG. 1 is an upper perspective view of one embodiment of the panel attachment structure of the present invention.

With reference to the embodiment shown in FIGS. 1-10, the panel attachment structure 10 can include a panel assembly 12 and an insert or insert assembly 14 that is configured to be received in and/or coupled to the panel assembly 12. The panel assembly 12 includes a base 16 which is shaped as a generally rectangular prism in the illustrated embodiment, but can have any of a variety of shapes, forms or sizes. The base 16 includes and/or has coupled thereto one or more reinforcing members 18 extending away from the base 16. In one case the reinforcing members 18 are coupled to and oriented perpendicular to an upper surface of the base 16. Each reinforcing member 18 can take the form of a rod, pole or elongated structure, and in the illustrated embodiment takes the form of rebar/reinforcing bar, such as rebar made of carbon steel, stainless steel, metal, composites or the like.

The panel assembly 12 can further include a channel member or tubular member 20 that, in the illustrated embodiment, is positioned on top of and/or coupled to the underlying base 16, and positioned between the reinforcing members 18. In the illustrated embodiment, the channel member 20 is a generally rectangular prism that is generally tubular/hollow and defines a generally rectangular prism channel 22 therein, having a mouth 24 at a distal end thereof. However, the shape and configuration of the channel member 20 and channel 22 can be varied as desired.

Figure 7:
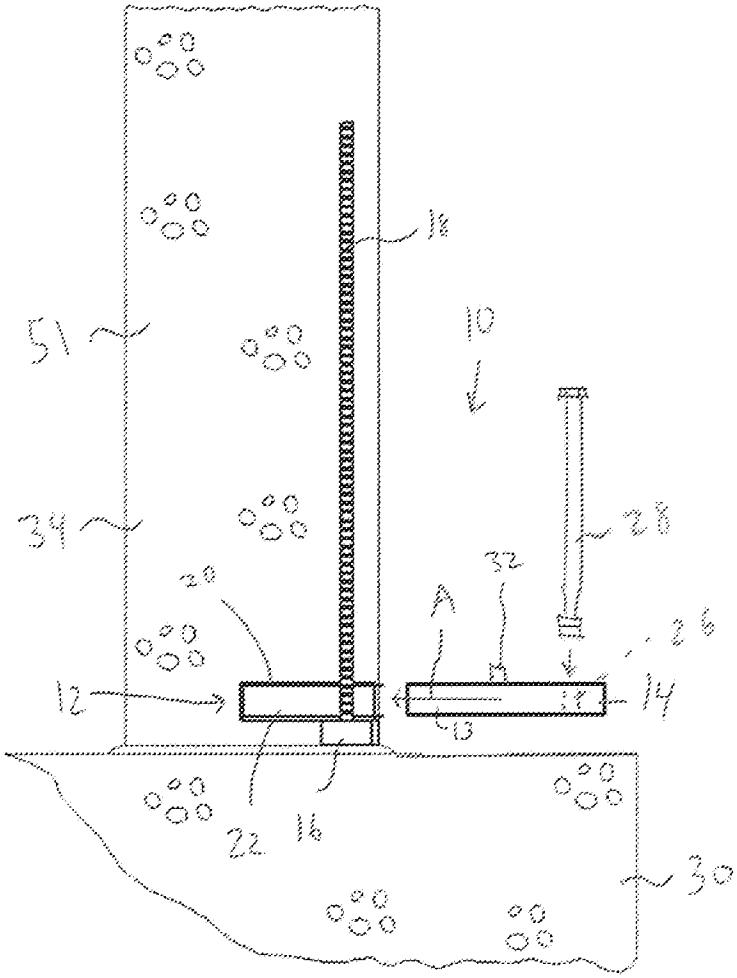
FIG. 7 is a side cross-sectional view that illustrates the panel assembly of FIG. 6, shown in conjunction with an insert and a fastener.

The panel attachment structure 10 can further include the insert or insert assembly 14 that is configured to be closely slidably received in the channel member 20/channel 22 in an insertion direction. In particular, as shown in FIG. 5, the insertable portion 13 of the insert 14 can have a rectangular prism shape (or other desired shape) that generally corresponds to the shape of the channel 22 and is configured to be closely received in the channel member 20/channel 22 in an insertion direction A (FIG. 7). Thus in one embodiment the insert 14 and/or insertable portion 13, has a smooth outer surface and is not cylindrical and is not a fastener, such as a threaded fastener or the like. The insert/insert assembly 14, in one case, is spaced away from and not directly coupled to the reinforcing member(s) 18. Both the channel 22 and the insert 14 (or at least those portions of the channel 22 configured to receive the insert 14, and at least the insertable portion 13 of the insert 14 configured to be received in the channel 22) can have a generally constant cross-sectional area along their length. In one embodiment, the insertable portion 13 of the insert 14 has a cross-sectional surface area that is within about 5 percent, in one case, and within about 3 percent in another case, or within 1 percent in yet another case, of the cross-sectional surface area of the receiving portion of the channel 22.

With reference to FIG. 7, the insert 14 can have an opening 26 formed therein, which is oriented generally perpendicular to the insertion direction A (or within about 20 degrees of perpendicular in one case, or within about 45 degrees of perpendicular in yet another case) and/or is oriented generally parallel to the reinforcing member(s) 18 (or within about 20 degrees in one case, or within about 45 degrees in another case). The opening 26 is configured to receive a fastener 28 therethrough for purposes which will be described in greater detail below.

Figure 8:
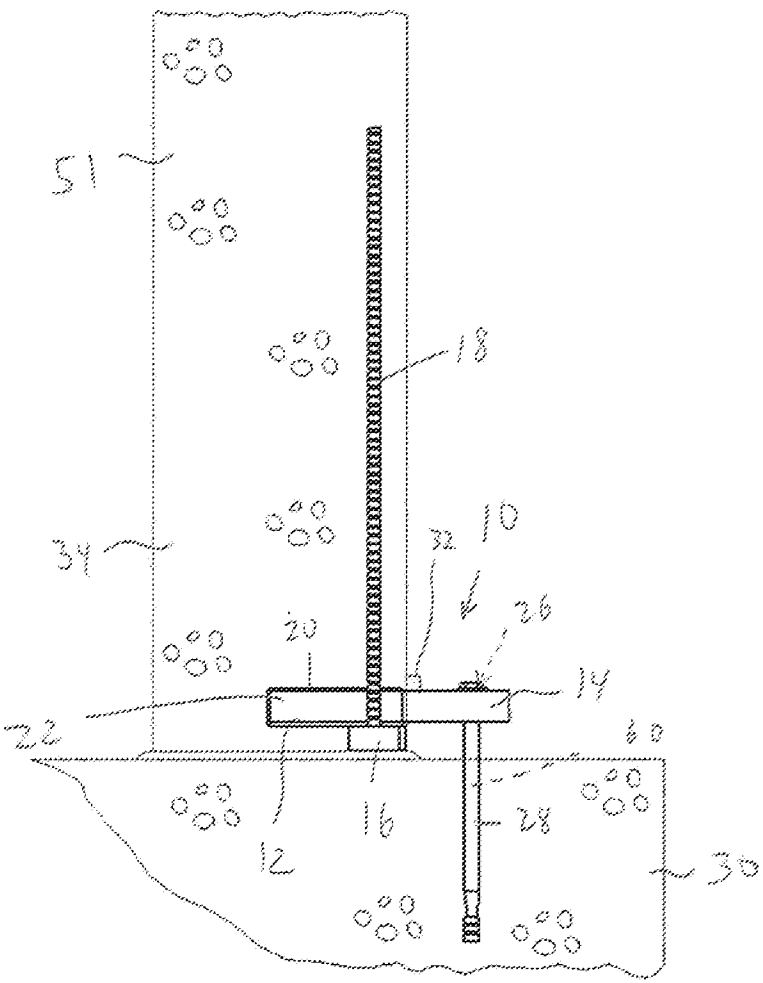
FIG. 8 shows the panel assembly and insert of FIG. 7 coupled together and secured to the support structure.

The insert 14, even when closely slidably received in the channel member 20, can be configured such that at least a portion of the insert 14 (e.g. a portions or portions other than the insertable portion 13) is positioned outside the channel 22. This positioning of the insert 14 may be desired to enable the insert 14 to be coupled to an underlying support structure 30 as will be described in greater detail below. In one embodiment, the insert 14 includes a bearing bar 32 positioned on an outer surface thereof (the upper surface in the illustrated embodiment) and configured to engage the channel member 20 to limit an insertion of the insert 14 into the channel member 20. Moreover, after the panel attachment structure 10 is installed, as shown in FIG. 8, the bearing bar 32 can also help to secure the panel 34 in place by providing a resistive force to the panel 34 moving forwardly (to the right in FIG. 8). It should be understood that the bearing bar 32 can be positioned at various other surfaces of the insert 14 beside the upper surface, including on the lower surface, or may be omitted if desired.

Each component of the panel assembly 12, including the channel member 20 and the base 16, and the insert 14, can be made of a wide variety of materials, including metals, fiberglass, composites, plastics, polymers or the like. In one particular embodiment, the channel member 20 is made of a polymer, while the base 16 and insert 14 are made of metal, since the channel member 20 may ultimately be surrounded by concrete (as will be described in greater detail below) and thus may require less structural strength. Furthermore, making the channel member 20 of plastic can reduce weight and cost. However, the channel member 20 can also be made of metal and, again, each of the various components can be made of different materials as desired.

In the illustrated embodiment, the bottom end of each reinforcing member 18 is coupled to the base 16, and the panel assembly 12 includes two reinforcing members 18, each positioned on opposite sides of the channel member 20. In some cases only a single reinforcing member 18 may be utilized, or more than two reinforcing members 18 may be utilized. Each reinforcing member 18 may be oriented generally perpendicular to the insertion direction A (i.e. each reinforcing member 18 extends generally vertically when the panel 34 is installed), but if desired the reinforcing members 18 can extend at varying angles in one case up to 20 degrees relative to the perpendicular direction (e.g. +/−20 degrees relative to vertical), or +/−45 degrees relative to vertical in another case).

In one embodiment the panel assembly 12 includes a face plate 36 coupled to a front face of at least the base 16. The face plate 36 can be made of a wide variety of materials, but in one embodiment is made of a polymer or plastic, but can be made of other materials described above for the other components of the panel attachment structure 10. The face plate 36 may be made of a softer material than the base 16 to act as a sacrificial component. In one case the face plate 36 is configured to protect any edges of the base 16, which can be made of metal, from scraping an underlying surface, such as a floor surface when the poured panel is dragged into place and/or tilted up. However the face plate 36 can be omitted if desired.

Figure 9:
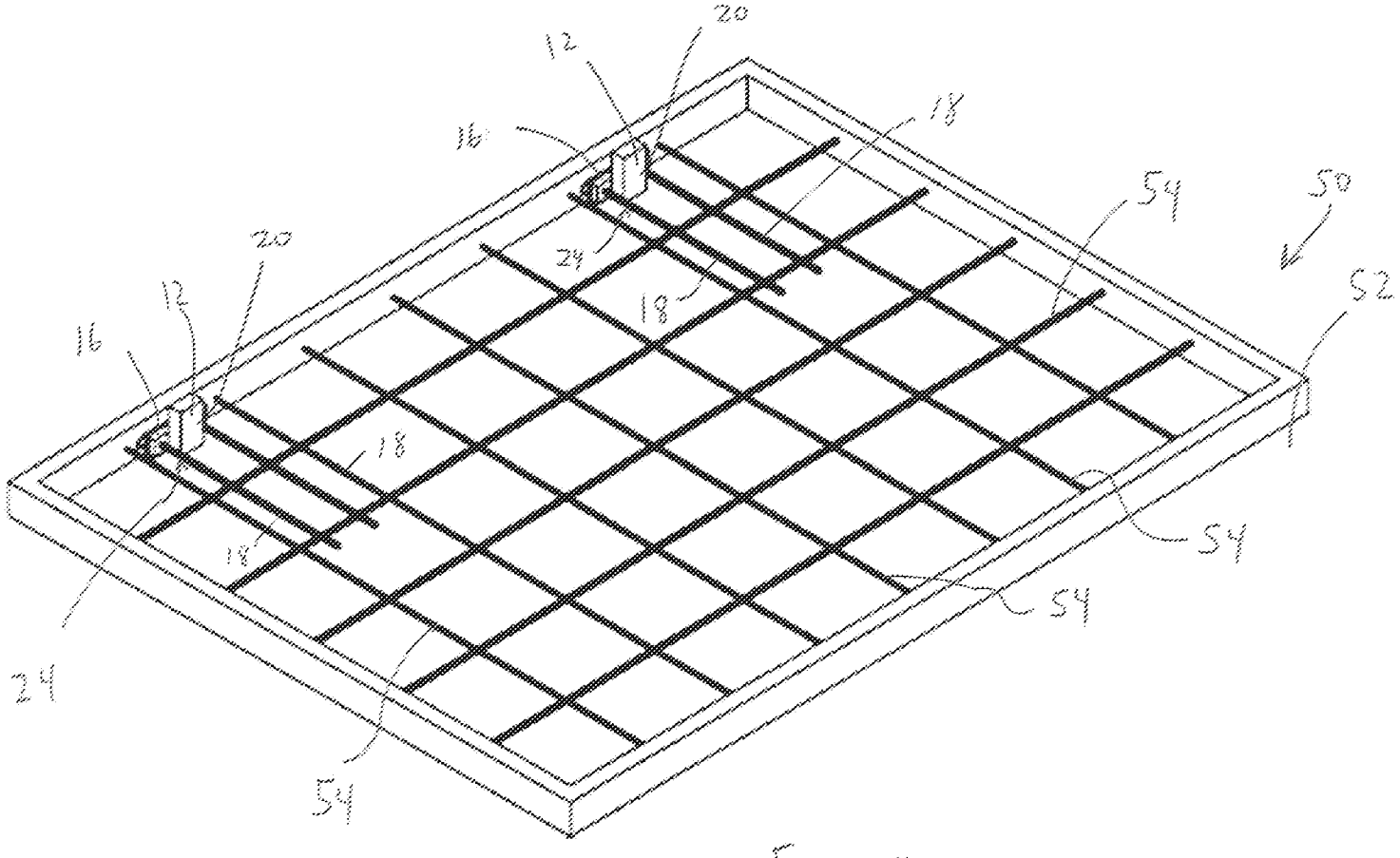
FIG. 9 illustrates the panel assembly of the panel attachment structure of FIG. 1, secured to a form which is prepared for concrete to be placed therein to form a panel.

The panel attachment structure 10 can be utilized to secure a generally vertically oriented structure such as a panel, wall, wall segment, precast or tilt-up concrete wall or the like (together, termed a "panel" 34 herein) to an underlying floor, support, foundation, footing or horizontal structure (collectively termed a "floor structure" 30 or "support structure" 30 herein). In particular, in order to secure a panel 34 to the underlying floor structure 30, the panel assembly 12 can first be coupled to/embedded in the panel 34. As shown in FIG. 9, in one embodiment a form 50 for forming a panel 34 is positioned on an underlying horizontal flat surface 52. The form 50 includes or take the shape of an outer rectangular frame in the illustrated embodiment, where the frame can be made of wood or other materials suitable for containing poured concrete. A plurality of intersecting/perpendicularly oriented reinforcing structures 54, such as rebar, are positioned in the frame such that the rebar 54 will be embedded in the panel 34 after the panel 34 is poured/formed.

The panel assembly 12, such as that shown in FIGS. 1-5, can be secured to the form 50, with the mouth 24 of the channel member 20 facing downwardly in the illustrated embodiment. The panel assembly 12 can include a plurality of attachment holes (not shown in the embodiment of FIGS. 1-5, but shown in the embodiment of FIGS. 11-15 described below) extending therethrough in a direction perpendicular to the insertion direction A and configured to enable the panel assembly 12 to be attached to the form 50. If desired, a cover 56 (see FIG. 17) can be positioned on/over the mouth 24 of the channel member 20 at this stage of the assembly process to ensure that the channel member 20 is not filled with concrete during the subsequent concrete pour step. In one embodiment the cover 56 takes the form of a flat rectangular component that can be secured to the face plate 36 and/or to the channel member 20. Alternatively, the cover 56 can take the form of a component that can be removably inserted into the channel 22 to prevent the channel 22 from being filled with concrete.

Figure 6:
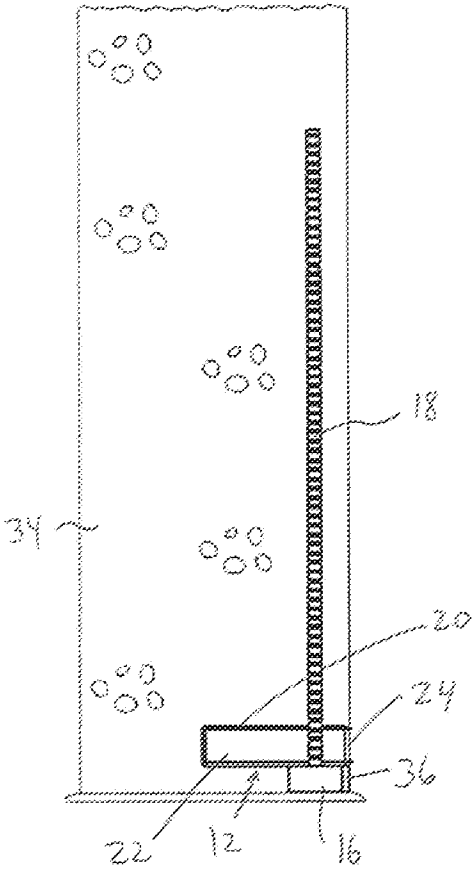
FIG. 6 is a side cross-sectional view that illustrates the panel assembly of FIGS. 1-5, installed in a panel.
Figure 5:
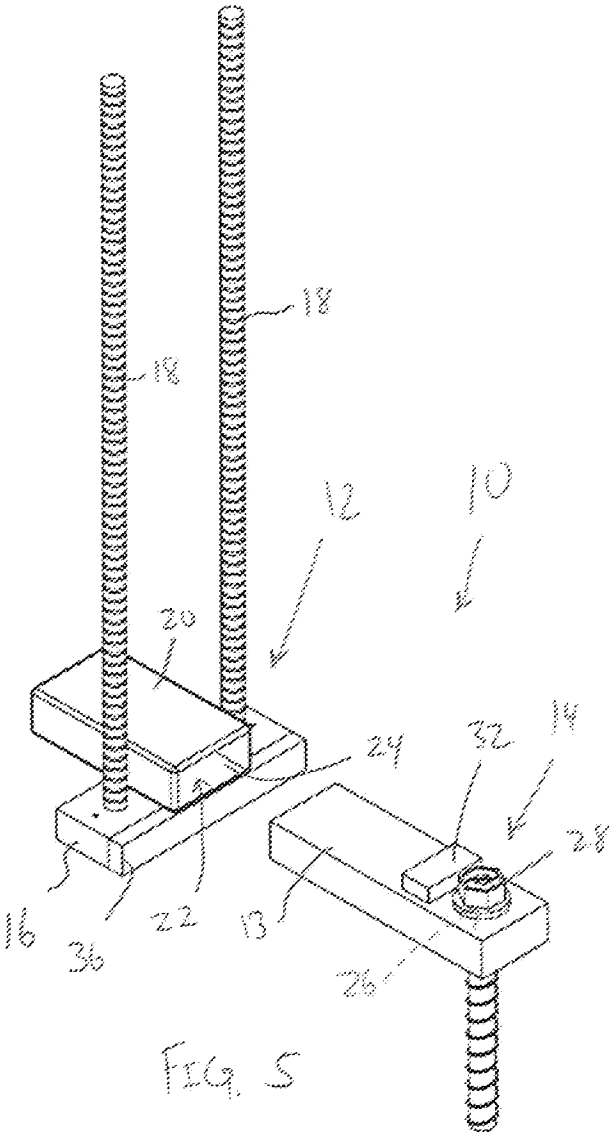
Figure 4:
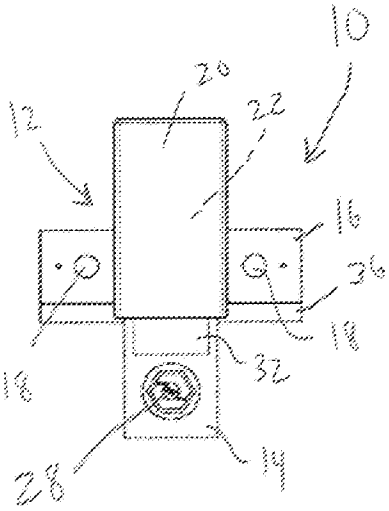
FIG. 4 is a top view of the panel attachment structure of FIG. 1.
Figure 10:
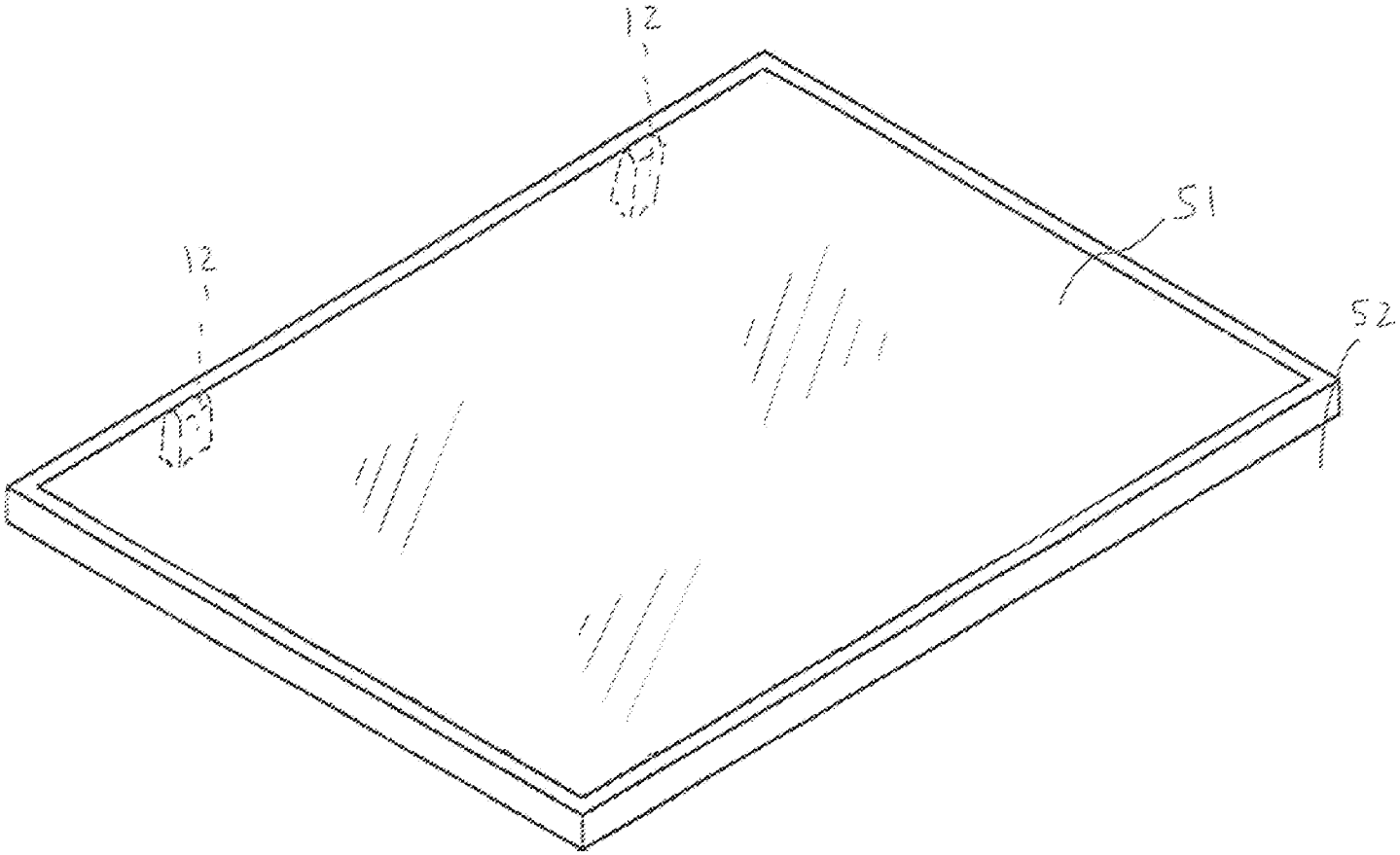
FIG. 10 illustrates the panel assembly and form of FIG. 9, where the form is filled with concrete formed therein to form a panel.
Figure 13:
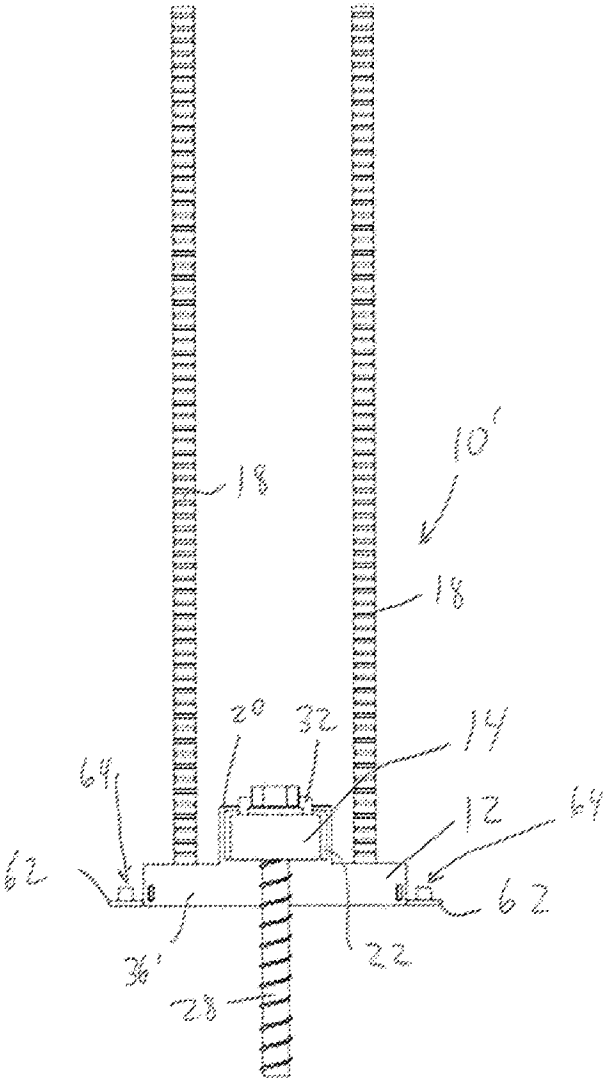
FIG. 13 is an end view of the panel attachment structure of FIG. 11.
Figure 13:
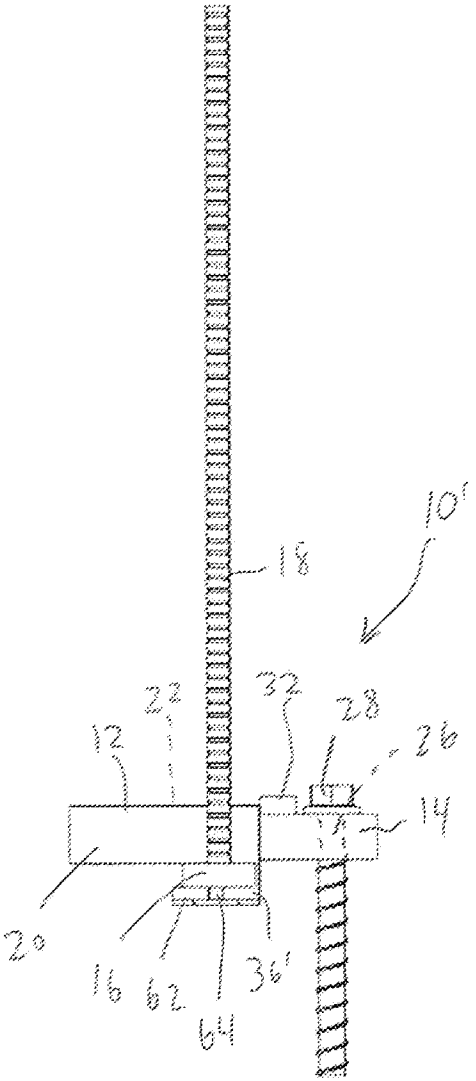
Figure 11:
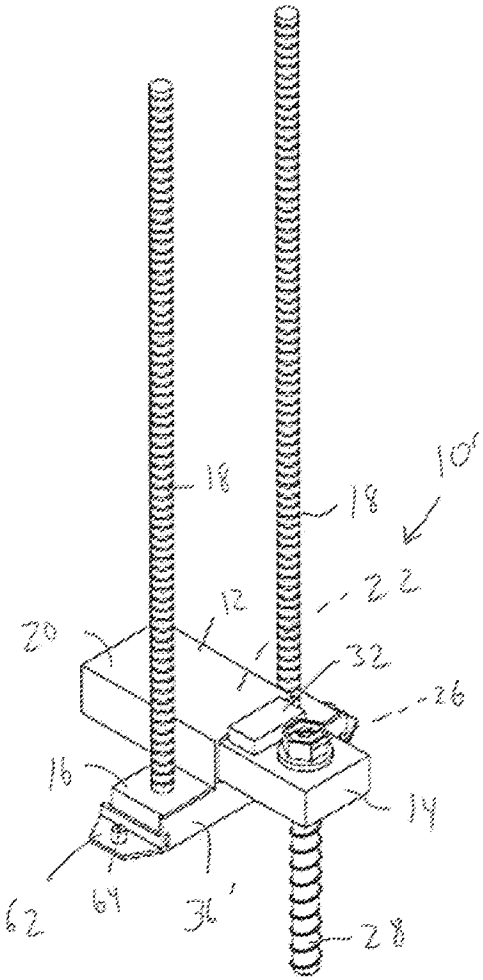
FIG. 11 is an upper perspective view of another embodiment of the panel attachment structure of the present invention.
Figure 15:
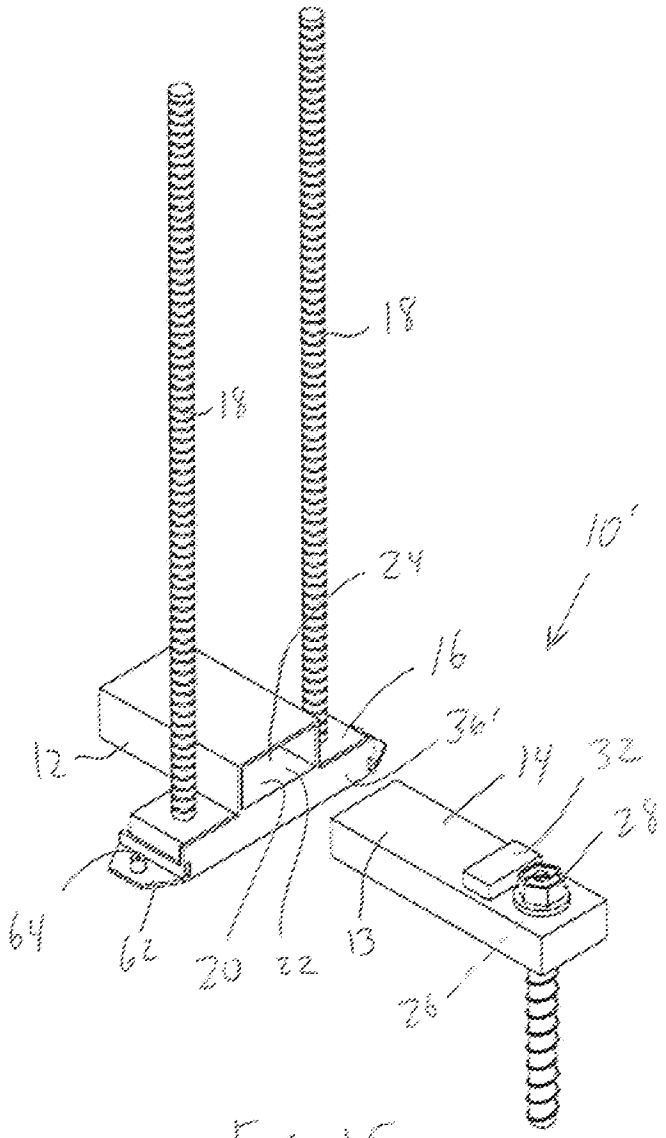
FIG. 15 illustrates the panel attachment structure of FIG. 11, with the insert exploded away from the panel assembly.
Figure 14:
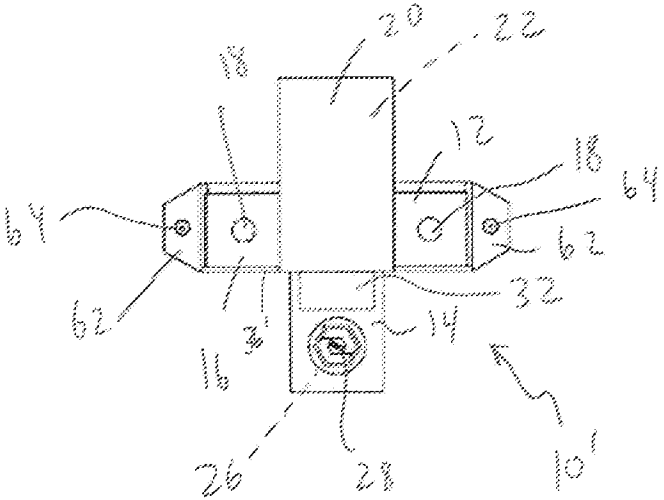
FIG. 14 is a top view of the panel attachment structure of FIG. 11.

After the system of FIG. 9 is assembled, the form 50 can be filled with concrete 51 and allowed to cure/harden, as shown in FIG. 10. The form 50 extending around the perimeter of poured concrete 51 is then removed and the resultant panel 34 is released/separated from the underlying horizontal surface 52, and lifted or tilted up to a vertical position, with the panel assembly 12 embedded therein, as shown in FIG. 6. As shown in FIG. 7, the panel 34 can then be positioned on top of a floor structure 30, and the insert 14 and fastener 28 can be provided, and the panel 34 has the channel 22 formed therein and oriented generally perpendicular to an outer surface of the panel 34. It should be noted that, although FIG. 7 shows the panel 34 in the form of a single concrete structure, the panel 34 can be made of any of variety of materials and have various constructions. For example, in some cases the panel 34 can include outer and/or inner layers/sublayers, such as insulated sandwich panels and/or insulated composite panels.

In order to then secure the panel 34 to the underlying floor structure 30, the cover 56 (if any) covering the channel 22 is removed, and the insert 14 (without the fastener 28 passed therethrough) is slidably inserted into the channel member 20 in the insertion (horizontal) direction A as shown in FIG. 7. Once the insert 14 is inserted into the desired depth, a hole or opening 60 is drilled or formed in the floor structure 30 in a vertical direction (or other desired direction), and the fastener 28 is passed through the opening 26 of the insert 14 and into the opening 60 of the floor structure 30 to thereby secure the panel 34 to the floor structure, as shown in FIG. 8. The fastener 28 in one case is a threaded fastener such as a galvanized threaded rod epoxy anchor or a galvanized threaded screw. If desired, an epoxy can be inserted in the opening 60 of the floor structure 30 to secure the fastener 28 in place. Unlike some other systems, the fastener 28 can be entirely spaced away from, and not directly coupled to the reinforcing member(s) 18.

Any tension forces (e.g. "uplift" forces that tend to move the panel 34 in the vertical direction of FIG. 8) are transmitted as a bending moment applied to the insert 14, and in turn to a bending/lifting/tension force applied to the fastener(s) 28. The secure attachment of the fastener(s) 28 to the floor structure 30 then transmits the tension forces to the floor structure 30 which can resist the tension/uplift forces.

Various panel attachment structures 10 can be spaced along the bottom edge of the panel 34 to secure the panel 34 to the floor structure as desired. For example, the embodiment of FIGS. 9 and 10 show two panel assemblies 12 along the panel 34, resulting in two panel attachments structures 10 once assembled, although more or less panel assemblies 12/panel attachments structures 10 can be utilized as desired. In one case, when the panel 34 is an exterior wall, the insert 14 and fastener 28 are positioned on the exterior surface of the wall. However, if desired the insert 14 and fastener 28 can be positioned on an interior surface of the wall.

FIGS. 11-15 illustrate an alternate embodiment of the panel attachment structure 10'. In this embodiment the face plate 36' extends around the mouth 24 of the channel 22, and also includes and/or is coupled to a pair of outwardly-protruding ears 62, with each ear 62 being positioned on an opposite side of base 16. Each ear 62 includes an attachment hole 64 extending therethrough in a direction perpendicular to the insertion direction A. Each attachment hole 64 is configured to receive a fastener (such as a nail, screw or the like, not shown) therethrough to enable the panel assembly 12 to be attached to the form 50 in the desired orientation during the pouring of concrete about the panel assembly 12, e.g. when in the configuration shown in FIG. 9. However, the attachment holes 64 can be located in a variety of different positions and have varying configurations beyond those shown in the embodiment of FIGS. 11-15.

Figure 17:
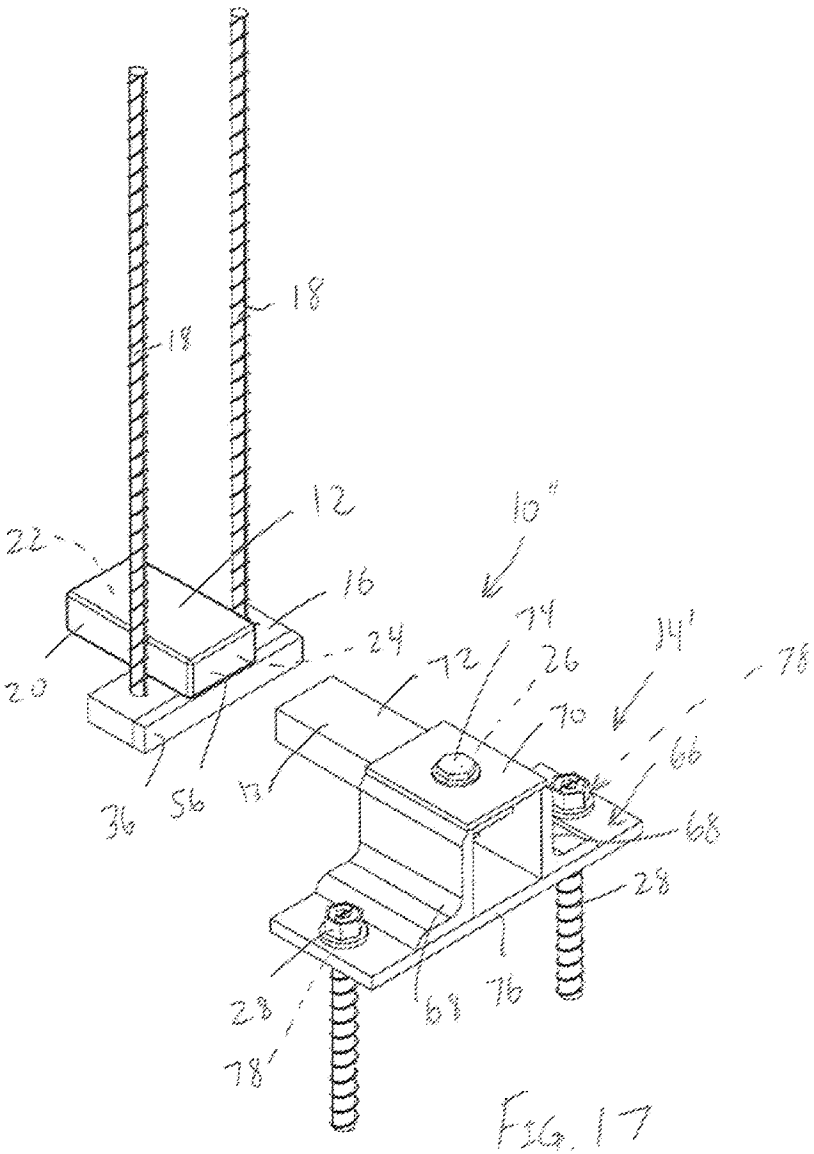
FIG. 17 illustrates the panel attachment structure of FIG. 16 with the insert exploded away from the panel assembly and with a cover on the tubular member.
Figure 18:
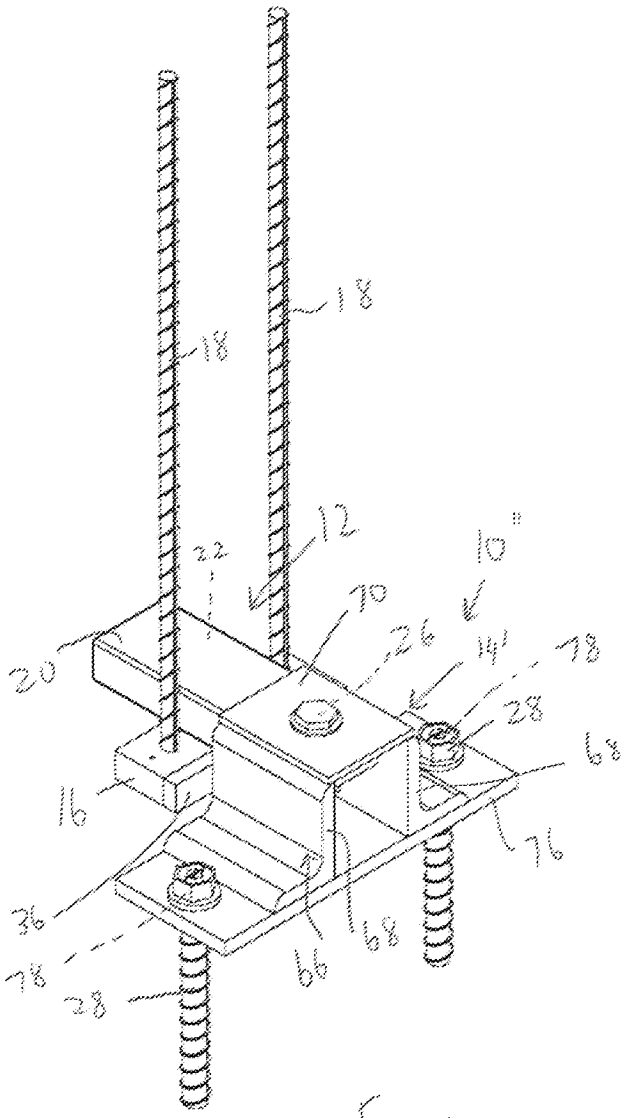
FIG. 18 is a side cross-sectional view that illustrates the panel attachment structure of FIG. 16, in its installed position.
Figure 18:
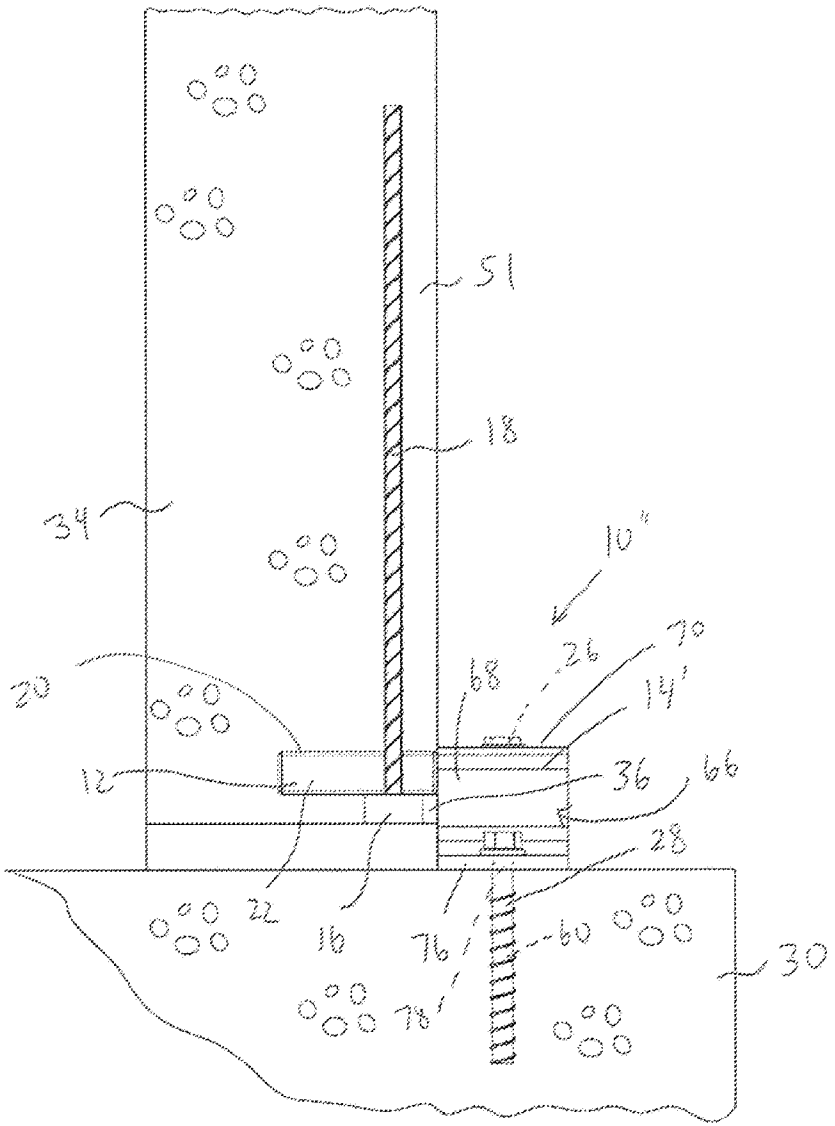

FIGS. 16-18 illustrate a further alternate embodiment of the panel attachment structure 10" which may be used to more securely couple the panel 34 to the floor structure 30 at the desired location. In this case the insert or insert assembly 14' includes or is coupled to a support bracket 66 including, in one case, two generally "L" shaped components, legs or brackets 68 which act as support bracket sidewalls, and an upper plate 70. A distal end of the insert body 72 is coupled to the support bracket 66 by an insert fastener 74 in one case that extends through the insert body 72 and the upper plate 70. The L-shaped components 68 are, in turn coupled to an underlying support plate 76 such as by welding or the like. The support plate 76 includes a pair of support plate openings 78, each of which are configured to receive a fastener 28 therethrough that is received in the floor structure 30, as shown in FIG. 18. Moreover, if desired the insert fastener 74 can have a greater length than that shown and extend through the underlying support plate 76 and into the floor structure 30 to provide additional attachment between the support bracket 66 and the floor structure 30. As shown in FIG. 18, in one embodiment, when installed the panel attachment structure 10" is positioned flush up against the panel 34 to help hold the panel 34 in place relative to a vertical plane and limit forward motion of the panel 34.

The embodiment of FIGS. 16-18 can provide a stronger connection between the panel 34 and the floor structure 30, due to the presence of the support plate 76 and brackets 68, and the use of two fasteners 28 to better distribute loads and forces. In particular, the embodiment of FIGS. 16-18 may be used to secure the panel 34 to the floor structure 30 when it is desired to better accommodate in-plane and out-of-plane shear forces applied to the panel attachment structure 10; e.g. when the panel 34 experiences forces to cause the panel 34 to try to move in a direction in the plane of or out of the plane of the page of FIG. 18. Such forces may be applied when seismic forces or the like are experienced. In such movement, the shear forces are transmitted to the brackets 68, which in turn transmit the forces to the underlying support plate 76, and ultimately into the floor structure 30 via the fasteners 28.

The panel attachment structure 10" of FIGS. 16-18 may in one case be positioned along the center of the panel 34 (e.g. the middle 25% in one case, or the middle 50% in another case), as opposed to the outer edges. In particular, the panel attachment structure 10" of FIGS. 16-18 provides a relatively rigid connection, and a more flexible connection (such as those of FIGS. 1-15) may be desired to be used on the outer edges of the panel 34 where concrete shrinkage and thermal movements may be more prominent.

Figure 20:
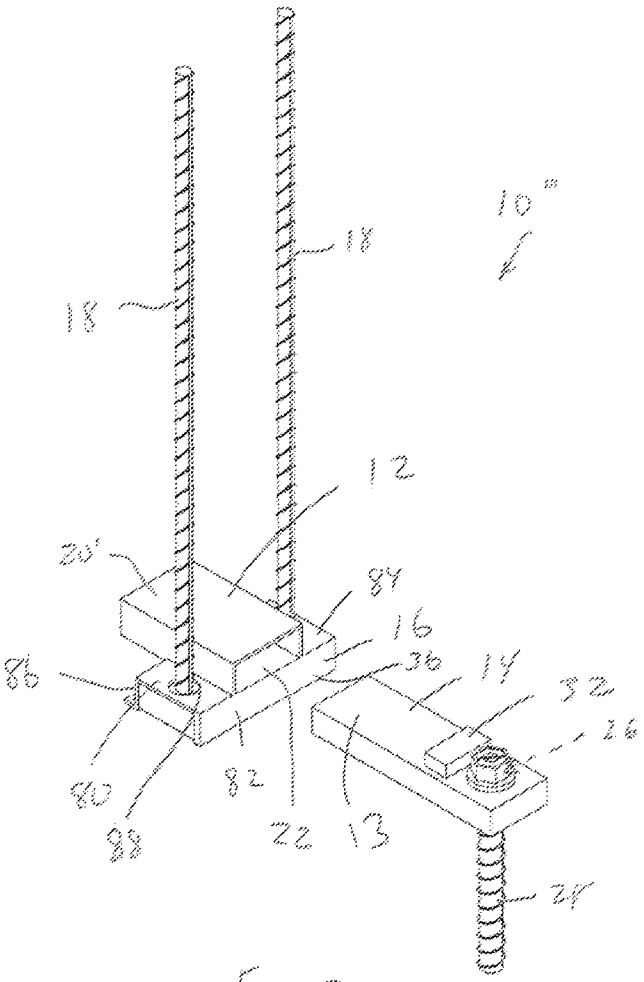
FIG. 20 is an upper perspective view of the panel attachment structure of FIG. 20, with the tubular member positioned on top of the base.
Figure 19:
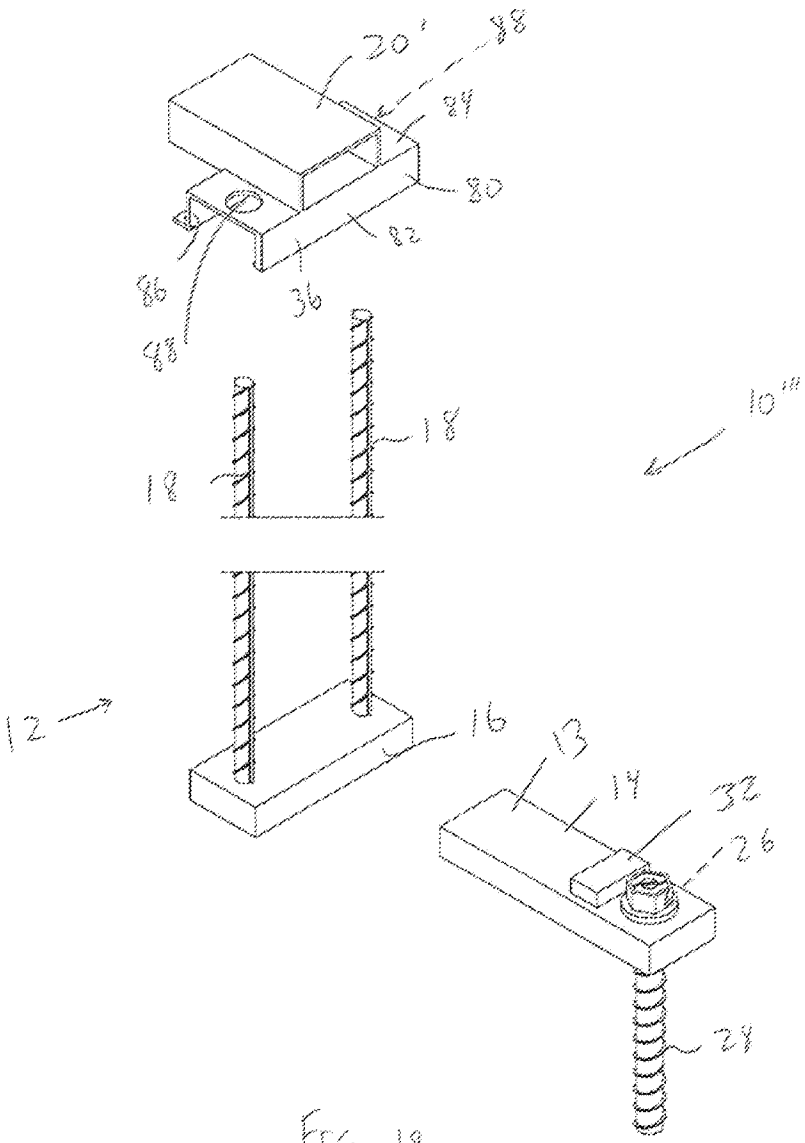
FIG. 19 is an upper perspective view of another embodiment of the panel attachment structure of the present invention, with the tubular member exploded away from the base.

FIGS. 19 and 20 illustrate a further alternate embodiment of the panel attachment structure 10'". In this embodiment the channel member 20' includes a frame structure 80 configured to closely fit over the base 16. In particular the frame structure 80 includes a front wall 82, upper wall 84 and back wall 86. A pair of openings 88 are positioned in the upper wall 84 and configured to receive the reinforcing members 18 therethrough, as shown in FIG. 20, to help properly locate and to secure the channel member 20' in place. In this embodiment the front wall 82 can take the place of and/or be considered the face plate 36 as described in the embodiments above. The channel member 20' can be secured to the base 16 if desired, such as by fasteners, mechanical attachments, adhesives or the like.

In the embodiment of FIGS. 19 and 20, the channel member 20' can be made of a different material than that of the base 16, such as metals, fiberglass, composites, plastics, polymers or the like. When the channel member 20' is made of a non-metal material, such as plastics or polymers, various cost and weight savings can be provided as described above.

The methods and structures disclosed herein, for securing a panel 34 to a floor structure 30, provides an intuitive, easy to operate and readily verifiable installation process. The system and method can be installed using the same basic skills and equipment required for temporary panel brace installation. In addition, the system and method does not require any mixing and placing of grout to complete the connection, and instead after pouring the panel 34, the insert 14 needs merely to be inserted into the channel member 20, and the fastener(s) 28 merely needs to be secured in place. The panel attachment structure 10, 10', 10", 10'" can be positioned near or at the bottom of the panel 34, and presents a low profile design. In particular, in one case the panel attachment structure 10, 10', 10", 10'" may extend no more than about 12 inches in one case, or no more than about 6 inches in another case, or no more than about 5 inches in yet another case, above the floor structure 30, once it is installed. In this manner when the panel 34 is grouted and backfilled, the panel attachment structure 10, 10', 10", 10'" can be buried under the backfill, and not be visible.

The panel attachment structure 10, 10', 10", 10'" also allows building slab on grade to be placed the full width prior to panel placement without the need for a fill-in slab placement. The system also does not require any welding thereby eliminates the need for additional skill set. The system can also be used to secure tilt-up panels that are cast on site, or precast panels that are cast at a remote location, and transported to the construction site.

The various components of the panel attachment structure 10, 10', 10", 10'" can be coated with zinc-rich coatings, hot dip galvanized finish, or other protective coatings. The panel attachment structure 10, 10', 10', 10"" can be provided in a single size which can be utilized with panels 34 of a variety of sizes and thicknesses. The fasteners 28 of the system can be installed vertically or close to vertically, and thus are not required to be installed at an angle (or a significant angle) which can compromise the strength of the fastener 28. The system does not require any panel patching after installation, and is not dependent on the top of the support structure elevation relative to the slab elevation. The slidable connection between the insert 14 and the panel assembly 12 enables ease of assembly and also accommodates horizontal movement of the panel 34 in or perpendicular to the insertion direction A due to, for example, temperature variation and shrinkage while still providing a secure connection.

Having described the invention in detail and by reference to the various embodiments, it should be understood that modifications and variations thereof are possible without departing from the scope of the claims of the present application.

What is claimed is:

1. A panel attachment structure comprising:

a panel assembly including a channel member having a channel therein, the panel assembly further including at least one reinforcing member directly or indirectly coupled to the channel member; and an insert assembly including an insert portion that is closely slidably received in the channel member in an insertion direction, wherein the insert assembly is coupled to an underlying support structure, and wherein the insert assembly includes a bearing component positioned on an outer surface thereof to engage a portion of the channel member to limit the insertion of the insert assembly into the channel member in the insertion direction.

2. The attachment structure of claim 1 wherein the reinforcing member is oriented generally perpendicular to the insertion direction, or at an angle of within 25 degrees of perpendicular to the insertion direction.

3. The attachment structure of claim 1 wherein the panel assembly further includes a base coupled to the channel member, and wherein the at least one reinforcing member is directly coupled to the base.

4. The attachment structure of claim 3 wherein the base is generally shaped as a rectangular prism, wherein the panel assembly includes a supplemental reinforcing member coupled to the base on an opposite side of the base relative to the channel member, and wherein reinforcing member and the supplemental reinforcing member are rebar.

5. The attachment structure of claim 3 wherein the panel assembly includes a face plate coupled to an outer face of the base.

6. The attachment structure of claim 5 wherein the face plate includes a plurality of attachment holes extending therethrough in a direction perpendicular to the insertion direction and configured to enable the panel assembly to be attached to a form during a pouring of concrete about the panel assembly.

7. The attachment structure of claim 1 wherein the panel assembly includes a plurality of attachment holes extending therethrough in a direction perpendicular to the insertion direction and configured to enable the panel assembly to be attached to a form during a pouring of concrete about the panel assembly.

8. The attachment structure of claim 1 wherein the insert assembly includes an opening formed therethrough that is configured to receive a fastener therethrough to couple the insert assembly to the underlying support structure, and wherein the opening is oriented in a direction generally perpendicular to the insertion direction.

9. The attachment structure of claim 1 wherein the insert assembly includes a support bracket including a pair support bracket sidewalls and a support plate positioned below the support bracket sidewalls, wherein the support plate is configured to be coupled to the support structure.

10. The attachment structure of claim 9 wherein the support plate includes a pair of openings formed therethrough, each of which is configured to receive a fastener therethrough.

11. The attachment structure of claim 1 wherein the insert portion is shaped as a rectangular prism configured to be closely received in the channel.

12. The attachment structure of claim 1 wherein the channel member is generally closed except for an open end, and wherein the attachment structure further includes a cover configured to removably cover an open end of the channel member.

13. The attachment structure of claim 1 wherein at least part of the insert assembly is configured to be positioned outside of the channel, when the insert assembly is received in the channel member, to enable the insert assembly to be coupled to the support structure.

14. The attachment structure of claim 1 wherein the bearing component is configured and positioned to engage the channel member when the insert portion is sufficiently inserted into the channel to limit the insertion of the insert assembly into the channel member.

15. The attachment structure of claim 1 wherein the channel member is a tubular member having a generally constant hollow cross sectional shape along at least part of its length.

16. The attachment structure of claim 1 wherein the insert portion is not a threaded fastener.

17. The attachment structure of claim 1 wherein the portion of the insert assembly that engages the portion of the channel member is positioned outside an outer perimeter of the channel, when the channel is viewed along the insertion direction.

18. The attachment structure of claim 17 wherein the insert assembly has a longer length than the channel member to thereby limit the insertion of the insert assembly into the channel member.

19. The attachment structure of claim 17 wherein the channel is closed on all sides except for a mouth at one end configured to receive the insert portion therein.

20. A panel attachment structure comprising:

a panel assembly including a channel member having a tubular channel therein, the panel assembly further including at least one reinforcing member directly or indirectly coupled to the channel member; and an insert assembly including an insert portion that is received in a receiving portion of the channel member, wherein the insert portion has a cross-sectional surface area that is within about 5 percent of the cross-sectional surface area of the receiving portion of the channel, wherein the at least one reinforcing member is oriented generally perpendicular to the insertion direction, or at an angle of within 25 degrees of perpendicular to the insertion direction, wherein the insert assembly is coupled to an underlying support structure, and wherein the insert assembly includes an opening that receives a fastener therethrough to couple the insert assembly to the underlying support structure.

21. The structure of claim 7 the opening is oriented in a direction generally perpendicular to the insertion direction.

22. The attachment structure of claim 20 wherein the insert assembly includes a bearing component on an outer surface of thereof and positioned to engage the channel member when the insert portion is sufficiently inserted into the channel to limit the insertion of the insert assembly into the channel member such that the opening is positioned outside the channel.

23. A panel system comprising:

a panel including a tubular channel formed therein and extending generally perpendicular to an outer surface of the panel;

a panel assembly embedded in the panel, the panel assembly including at least one reinforcing member embedded in the panel;

an insert assembly having an insert portion closely received in the channel, wherein the insert assembly is not directly coupled to the at least one reinforcing member, and wherein at least part of the insert assembly is positioned externally of the channel; and a fastener positioned entirely externally of the panel and extending through the part of the insert assembly that is positioned externally of the channel to couple the insert assembly to an underlying support structure.

24. The system of claim 23 wherein the panel assembly includes a channel member defining the channel.

25. The system of claim 23 wherein the fastener is oriented vertically.

26. The system of claim 23 wherein the insert assembly includes an opening that receives the fastener therein, wherein the opening is positioned externally of the channel.

27. The system of claim 23 wherein the insert portion is not a threaded fastener, and wherein the panel assembly at least partially defines the channel.

28. The system of claim 23 wherein the wherein the insert portion has a cross-sectional surface area that is within about 5 percent of the cross-sectional surface area of the receiving portion of the channel.

29. A method for connecting a panel to a support structure comprising:

accessing a panel assembly having a channel member including a tubular channel therein, the panel assembly further including at least one reinforcing member directly or indirectly coupled to the channel member;

causing the panel assembly to be positioned in an uncured concrete panel;

allowing the panel to cure;

after the allowing step, inserting an insert portion of an insert assembly into the channel in an insertion direction generally perpendicular to an outer surface of the panel such that at least part of the insert assembly is positioned externally of the channel; and securing the externally positioned part of the insert assembly to the support structure, by a fastener, to thereby connect the panel to the support structure.

30. The method claim 29 wherein the panel is oriented vertically, the fastener is oriented vertically, and the support structure is oriented horizontally, and wherein the fastener is positioned entirely externally of the channel.

31. A panel attachment structure comprising:

a panel assembly including a channel member having a channel therein, the panel assembly further including at least one reinforcing member directly or indirectly coupled to the channel member; and an insert assembly including an insert portion that is configured to be closely slidably received in the channel member in an insertion direction, wherein the insert assembly is configured to be coupled to an underlying support structure, and wherein a portion of the insert assembly includes a bearing component positioned on an outer surface thereof that is configured and positioned to engage a portion of the channel member to limit the insertion of the insert assembly into the channel member, wherein the reinforcing member is positioned entirely externally of the channel.

* * * * *